US012286322B2

(12) United States Patent
Ito et al.

(10) Patent No.: US 12,286,322 B2
(45) Date of Patent: Apr. 29, 2025

(54) MEDIUM PLACEMENT DEVICE

(71) Applicant: SEIKO EPSON CORPORATION, Tokyo (JP)

(72) Inventors: Shun Ito, Matsumoto (JP); Moe Takeuchi, Shiojiri (JP); Keiichi Yato, Matsumoto (JP); Tsutomu Ozaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 176 days.

(21) Appl. No.: 18/069,657

(22) Filed: Dec. 21, 2022

(65) Prior Publication Data

US 2023/0202789 A1 Jun. 29, 2023

(30) Foreign Application Priority Data

Dec. 23, 2021 (JP) ..... 2021-209017

(51) Int. Cl.
*B65H 31/26* (2006.01)
*B65H 31/02* (2006.01)
*B65H 31/24* (2006.01)

(52) U.S. Cl.
CPC ..... *B65H 31/24* (2013.01); *B65H 31/26* (2013.01); *B65H 2301/4212* (2013.01); *B65H 2405/11* (2013.01); *B65H 2801/12* (2013.01)

(58) Field of Classification Search
CPC ..... B65H 31/26; B65H 31/02; B65H 31/24; B65H 31/20; B65H 31/22; B65H 2301/4212; B65H 2301/51214; B65H 2301/5222; B65H 2701/11312; B65H 2405/1111; B65H 2405/1112; B65H 2405/11152; B65H 2405/1412
See application file for complete search history.

(56) References Cited

U.S. PATENT DOCUMENTS 6,065,747 A * 5/2000 Khovaylo ..... B65H 31/02 271/209
7,793,932 B1 * 9/2010 Bartman ..... B65H 31/20 271/223
2016/0090261 A1 3/2016 Nagashima et al.
2017/0152122 A1 * 6/2017 Deocon Mir ..... B65H 31/10

FOREIGN PATENT DOCUMENTS

DE 19752027 A1 * 10/1998 ..... B65H 31/02
JP 09278261 A * 10/1997
JP 2016-69156 A 5/2016

* cited by examiner

*Primary Examiner* — Luis A Gonzalez
(74) *Attorney, Agent, or Firm* — WORKMAN NYDEGGER

(57) ABSTRACT

A medium placement device configured to stack a plurality of sheets of a medium discharged from a discharge unit of a processing device, the medium placement device including a plurality of support units being provided in a width direction intersecting with a discharge direction of the medium, and being configured to support, on a support surface from below in a gravitational direction, the medium discharged from the discharge unit. The plurality of support units are provided extending in the discharge direction, and are inclined downward in a gravitational direction from upstream to downstream in the discharge direction, and a first support unit and a second support unit arranged at a lower position in the gravitational direction with respect to the first support unit as viewed in the width direction, the first support unit and the second support unit being arranged alternatingly in the width direction.

10 Claims, 9 Drawing Sheets

MEDIUM PLACEMENT DEVICE

The present application is based on, and claims priority from JP Application Serial Number 2021-209017, filed Dec. 23, 2021, the disclosure of which is hereby incorporated by reference herein in its entirety.

BACKGROUND

1. Technical Field

The present disclosure relates to a medium placement device.

2. Related Art

Medium placement devices having various configurations have hitherto been used in various processing devices for performing processing on a medium, such as a printer and a scanner. For example, JP-A-2016-69156 discloses a stacker device that receives and stacks a medium discharged from a printer.

The stacker device in JP-A-2016-69156 is a medium placement device that stacks a medium without using electric power or the like. In some cases, a medium cannot suitably be stacked on such a medium placement device that stacks a medium without using electric power or the like, depending on a type of a medium to be used. For example, in the stacker device in JP-A-2016-69156, a tray on which a medium is stacked is inclined upward as approaching downstream in a discharge direction of the medium. Thus, when a medium that is less slippery on the tray is used, the medium is caught by the tray, and is jammed. In another case, when media are successively placed on the tray, a leading edge of a media moving to be newly placed thereon abuts against a placed medium that is stacked below, is caught, and pushes out the placed medium.

SUMMARY

In order to solve the above-mentioned problem, a medium placement device according to the present disclosure is configured to stack a plurality of sheets of a medium discharged from a discharge unit of a processing device. The medium placement device includes a plurality of support units provided in a width direction intersecting with a discharge direction of the medium discharged from the discharge unit, the plurality of support units being configured to support the medium at a support surface from below in a gravitational direction. The plurality of support units is provided extending in the discharge direction, and are inclined downward in a gravitational direction from upstream to downstream in the discharge direction, and as the plurality of support units, a first support unit and a second support unit are provided in an alternating manner in the width direction, the second support unit being arranged at a position lower than the first support unit in the gravitational direction when viewed in the width direction.

DESCRIPTION OF EXEMPLARY EMBODIMENTS

Figure 1:
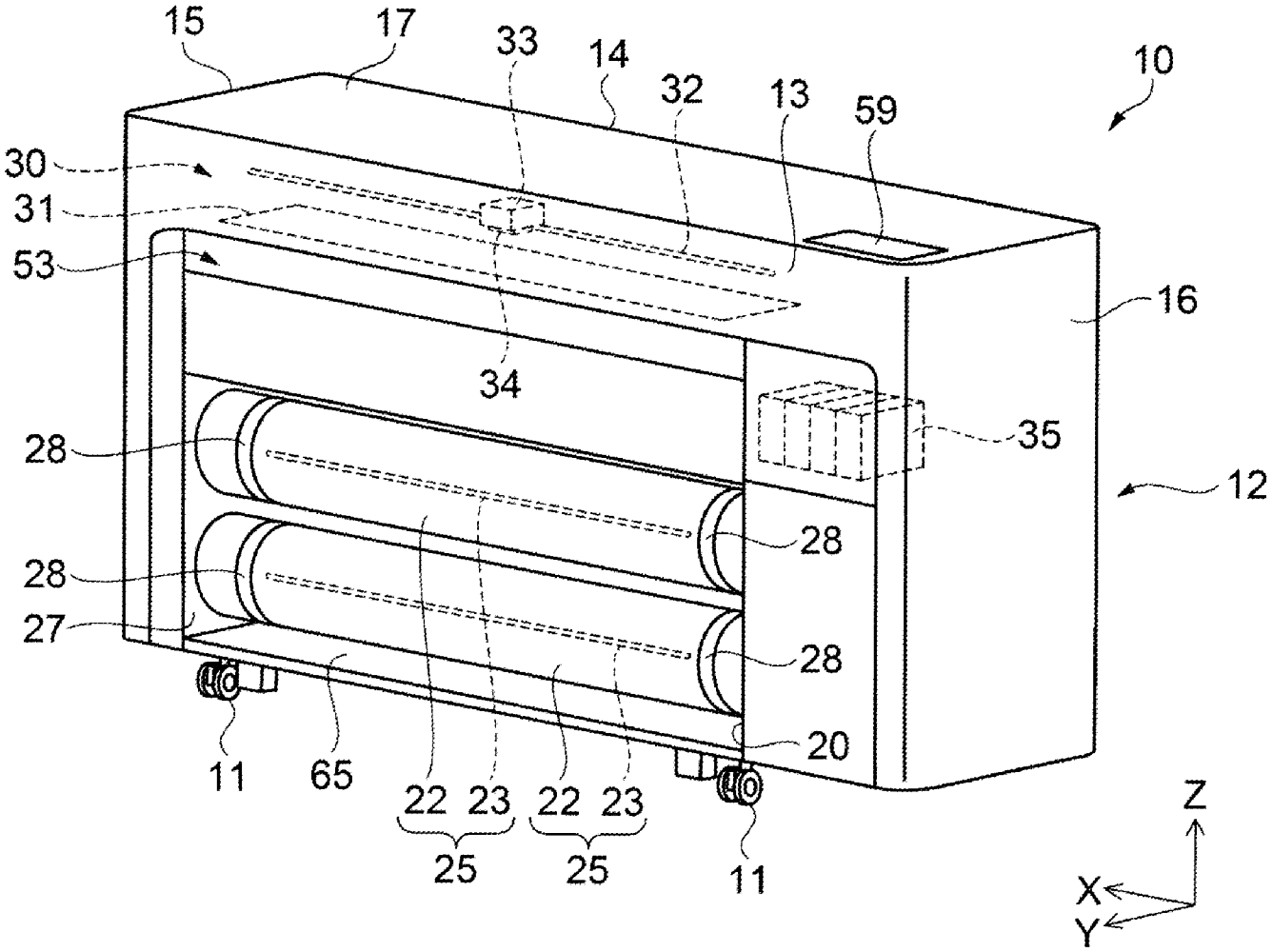
FIG. 1 is a perspective view of a recording device being an example of a processing device to which a medium placement device according to an exemplary embodiment of the present disclosure can be coupled.

First, the present disclosure is schematically described.

In order to solve the above-mentioned problem, a medium placement device according to a first aspect of the present disclosure is configured to stack a plurality of sheets of a medium discharged from a discharge unit of a processing device. The medium placement device includes a plurality of support units provided in a width direction intersecting with a discharge direction of the medium discharged from the discharge unit, the plurality of support units being configured to support the medium at a support surface from below in a gravitational direction. The plurality of support units is provided extending in the discharge direction, and are inclined downward in a gravitational direction from upstream to downstream in the discharge direction, and as the plurality of support units, a first support unit and a second support unit are provided in an alternating manner in the width direction, the second support unit being arranged at a position lower than the first support unit in the gravitational direction when viewed in the width direction.

According to the present aspect, the support unit is provided extending in the discharge direction, and is inclined downward in the gravitational direction from upstream to downstream in the discharge direction. With this, the medium can be moved through use of a gravitational force, and the medium can efficiently be moved without using electric power or the like. Further, as the support units, the first support unit and the second support unit are provided in an alternating manner in the width direction. Thus, a moving medium can have a wavy shape as viewed in the discharge direction. With this, the leading edge in the discharge direction can be prevented from hanging down, and can also be prevented from being caught by the support surface or a placed medium. Therefore, various types of the medium 22 can be stacked in a suitable manner without using electric power or the like.

In a medium placement device according to a second aspect of the present disclosure, in the first aspect, each of the plurality of support units includes an upstream portion located upstream in the discharge direction, a downstream portion located downstream of the upstream portion in the discharge direction, and an intermediate portion coupling the upstream portion and the downstream portion, and the intermediate portion is inclined steeper than the upstream portion and the downstream portion when viewed in the width direction.

For example, when an elongated medium is used, a jam of the medium to be discharged is more likely to occur at the intermediate portion. Here, according to the present aspect, the support unit includes the upstream portion, the downstream portion, and the intermediate portion, and the intermediate portion is inclined in a steeper manner than the upstream portion and the downstream portion as viewed in the width direction. As described above, the intermediate portion is inclined in a steeper manner, and hence the medium can be moved on the intermediate portion through use of a gravitational force in a particularly effective manner. Thus, various types of the medium can be stacked in a particularly suitable manner without using electric power or the like.

In a medium placement device according to a third aspect of the present disclosure, in the first aspect or the second aspect, a space is provided between the first support unit and the second support unit in the width direction, and a width of the space in the width direction is larger than a width of the support surface in the width direction.

According to the present aspect, the width of the space is larger than the width of the support surface. In other words, a contact area between the support surface and the medium is small. With this, a frictional force between the support surface and the medium can be reduced, and various types of the medium can be stacked in a particularly suitable manner without using electric power or the like.

A medium placement device according to a fourth aspect of the present disclosure, in any one of the first aspect to the third aspect, further includes a plurality of pressing units configured to press, from above in the gravitational direction, the medium supported by the plurality of support units, wherein each of the plurality of the pressing units is arranged at a position facing the support surface of the first support unit.

According to the present aspect, the pressing unit configured to press, from above in the gravitational direction, the medium supported on the support unit is provided, and the pressing unit is arranged at the position facing the support surface of the first support unit. Thus, the medium can be sandwiched in the vertical direction between the pressing unit and the support surface of the first support unit. With this, the medium can be prevented from curling as viewed in the width direction, and the part corresponding to the leading edge of the medium can be prevented from being caught by the support surface or a placed medium in a suitable manner.

A medium placement device according to a fifth aspect of the present disclosure, in the fourth aspect, further includes a regulation unit including a regulation surface provided to extend from a side close to the support surface to a side close to the pressing unit, the regulation unit being configured to prevent the medium supported by the plurality of support units from moving downstream in the discharge direction, wherein at the regulation surface, an end portion on a side close to the pressing unit is located downstream in the discharge direction with respect to an end portion on a side close to the support surface when viewed in the width direction, so that the regulation surface is arranged to be more inclined than a line perpendicular to the support surface.

According to the present aspect, the regulation unit configured to prevent the medium supported on the support unit from moving downstream in the discharge direction. With this, when the media are continuously placed on the support unit, the leading edge of the subsequent medium that is moving for placement is prevented from abutting against and being caught by a placed medium that is previously stacked below the subsequent medium. Thus, in an effective manner, the placed medium can be prevented from being pushed out from the support unit. Further, the regulation surface has the end on the side close to the pressing unit, which is arranged downstream of the end on the side close to the support surface in the discharge direction, and hence is arranged to be inclined more than the vertical line with respect to the support surface. With this configuration, the medium being discharged from the discharge unit can be prevented from being caught by a trailing edge of the placed medium in an effective manner. Therefore, a large number of media can be stacked in an efficient manner.

In a medium placement device according to a sixth aspect of the present disclosure, in the fifth aspect, the regulation unit is movable along the discharge direction.

According to the present aspect, the regulation unit is movable along the discharge direction. With this, the position of the regulation unit can suitably be changed in accordance with a length of the medium to be used, and hence the medium can suitably be stacked.

In a medium placement device according to a seventh aspect of the present disclosure, in any one of the fourth aspect to the sixth aspect, as the plurality of pressing units, an upstream pressing unit and a downstream pressing unit are provided, the downstream pressing unit being arranged at a position that is including a center in the width direction and is downstream of the upstream pressing unit in the discharge direction.

According to the present aspect, the pressing unit includes the upstream pressing unit and the downstream pressing unit arranged at the position including the center in the width direction. With this, only the upstream pressing unit can be used when a short medium is used, and both the upstream pressing unit and the downstream pressing unit can be use when a long medium is used. Therefore, even when the long medium is used as well as the short medium, the medium can effectively be sandwiched between the pressing unit and the support surface in the vertical direction.

In a medium placement device according to an eighth aspect of the present disclosure, in the seventh aspect, the upstream pressing unit includes a base portion provided extending in the discharge direction, and a plurality of arm portions provided at positions facing the support surface on the base portion, each of the plurality of arm portions includes a base end attached to the base portion so as to move rotatably in the width direction as a rotational movement axis, and is provided with a rotating member rotatable with the width direction as a rotation axis at a distal end on an opposite side of the arm portion from the base end, the downstream pressing unit is provided with a plurality of rotors at positions facing the support surface, the plurality of rotors provided extending in the discharge direction and being rotatable with the width direction as a rotation axis, and a gap between the downstream pressing unit and the support surface is smaller than a gap between the base portion and the support surface.

In general, when the short medium is used, the number of stacked media is greater than a case in which the long medium is used. According to the present aspect, the gap between the downstream pressing unit and the support surface is smaller than the gap between the base portion and the support surface. Thus, the number of media that can be stacked when a short medium is used can be larger than the number of media that can be stacked when a long medium is used. Further, the upstream pressing unit includes the base portion and the plurality of arm portions. The base end of the arm portion can rotatably move in the width direction as a rotational movement axis with respect to the base portion, and the distal end of the arm portion is provided with the rotating member. With this configuration, the medium can firmly be pressed down upstream in the discharge direction, and the medium can suitably be moved.

A medium placement device according to a ninth aspect of the present disclosure, in any one of the first aspect to the eighth aspect, further includes a caster on a lower side in the gravitational direction at a downstream end in the discharge direction.

According to the present aspect, the caster is provided on the lower side in the gravitational direction at the downstream end in the discharge direction. With this, the caster can be installed on the installation surface, and thus the medium placement device can stably be installed. Moreover, the medium placement device can easily move.

With reference to the drawings, a medium placement device 100 according to an exemplary embodiment of the present disclosure is specifically described below. The medium placement device 100 according to the present exemplary embodiment is a medium placement device configured to stack a plurality of sheets of a medium 22 discharged from a discharge unit 53 of a recording device 10 being an example of a processing device. Note that the medium placement device 100 according to the present exemplary embodiment can be coupled to the recording device 10 being an example of a processing device, and may be coupled to a processing device other than the recording device, such as an image reading device. First, with reference to FIG. 1, an outline of the recording device 10 is described.

Note that, as for the coordinates illustrated in the drawings, assuming that a recording device 10 is placed on a horizontal installation surface, the three virtual axes orthogonal to one another are defined as an X-axis, a Y-axis, and a Z-axis. The X-axis is a virtual axis parallel to a right-left direction of the recording device 10. The Y-axis is a virtual axis parallel to a front-rear direction of the recording device 10. The Z-axis is a virtual axis parallel to a height direction (gravitational direction) of the recording device 10. A tip side of each of the arrows representing the X-axis, the Y-axis, and the Z-axis is a "+ side", and a base side thereof is the "− side". The recording device 10 illustrated in the present exemplary embodiment is a large-format printer that feeds an elongated medium 22 wound in a roll shape and performs recording by an ink-jet method. The recording device 10 in the present exemplary embodiment is a printer capable of performing recording on the medium 22 having a size of B0 plus to the maximum.

As illustrated in FIG. 1, the recording device 10 is installed through casters 11. The recording device 10 includes a housing 12 having a substantially rectangular parallelepiped shape that is elongated in X direction. The housing 12 has a front wall 13, a rear wall 14, a first side wall 15, a second side wall 16, and an upper wall 17. A direction in which a base frame 65 and the upper wall 17 face each other in the recording device 10 is a height direction of the recording device 10. A direction in which the first side wall 15 and the second side wall 16 face each other is a right-left direction of the recording device 10. A direction in which the front wall 13 and the rear wall 14 face each other is a front-rear direction of the recording device 10.

A recording unit 30 that performs recording on the medium 22 and includes a recording head 34, and an accommodation unit 20 that accommodates a roll body 25 in which the medium 22 is wound in a cylindrical shape are provided inside the housing 12. Further, although not illustrated in FIG. 1, a transport unit that transports the medium 22, a cutting unit that cuts the medium 22, and the like are provided.

A plurality of openings is formed in the front wall 13 of the housing 12. A roll body accommodation port 27 for accommodating the roll body 25 is formed on a side close to the base frame 65 below the front wall 13. Further, the discharge unit 53 for discharging the medium 22 after recording is formed on the upper side of the roll body accommodation port 27.

The roll body 25 having a cylindrical shape formed by winding the elongated medium 22 about a core member 23 is accommodated in the accommodation unit 20 through the roll body accommodation port 27. In the present exemplary embodiment, the accommodation unit 20 is configured so that two roll bodies 25 elongated in the X direction are arrayed in the Z direction. A pair of holding members 28 that holds the roll body 25 rotatably with respect to the accommodation unit 20 is attached to both ends of the roll body 25. When the roll body 25 is driven to rotate, the medium 22 wound about the roll body 25 is delivered to the side close to the rear wall 14 inside the housing 12. Further, the transport unit, which is not illustrated, transports the medium 22 to a support 31, and the medium 22 is transported from the side close to the rear wall 14 to the side close to the front wall 13 on the support 31.

The recording unit 30 includes the support 31, a guide member 32, a carriage 33, and the recording head 34. The support 31 is a plate-shaped member extending in the X direction in the housing 12, is positioned on the side close to the upper wall 17 with respect to the accommodation unit 20, and supports the medium 22 transported by the transport unit, which is not illustrated.

The recording head 34 is mounted on the carriage 33 that moves along the guide member 32. The recording head 34 is positioned on the side close to the support 31 with respect to the carriage 33. The recording head 34 is configured so as to reciprocate along the guide member 32 together with the carriage 33. The recording head 34 is coupled to a cartridge 35 that stores ink by a tube having flexibility, which is not illustrated. The recording head 34 performs recording on the medium 22 by ejecting the ink onto the medium 22 supported by the support 31 while moving in the X direction. The medium 22 after recording is cut by the cutting unit, which is not illustrated.

The recording device 10 further includes an input unit 59. The input unit 59 is provided at an upper surface of the upper wall 17 of the housing 12. The input unit 59 is configured, for example, by a liquid crystal display device provided with a touch panel, and is used when a user inputs various types of information.

Figure 2:
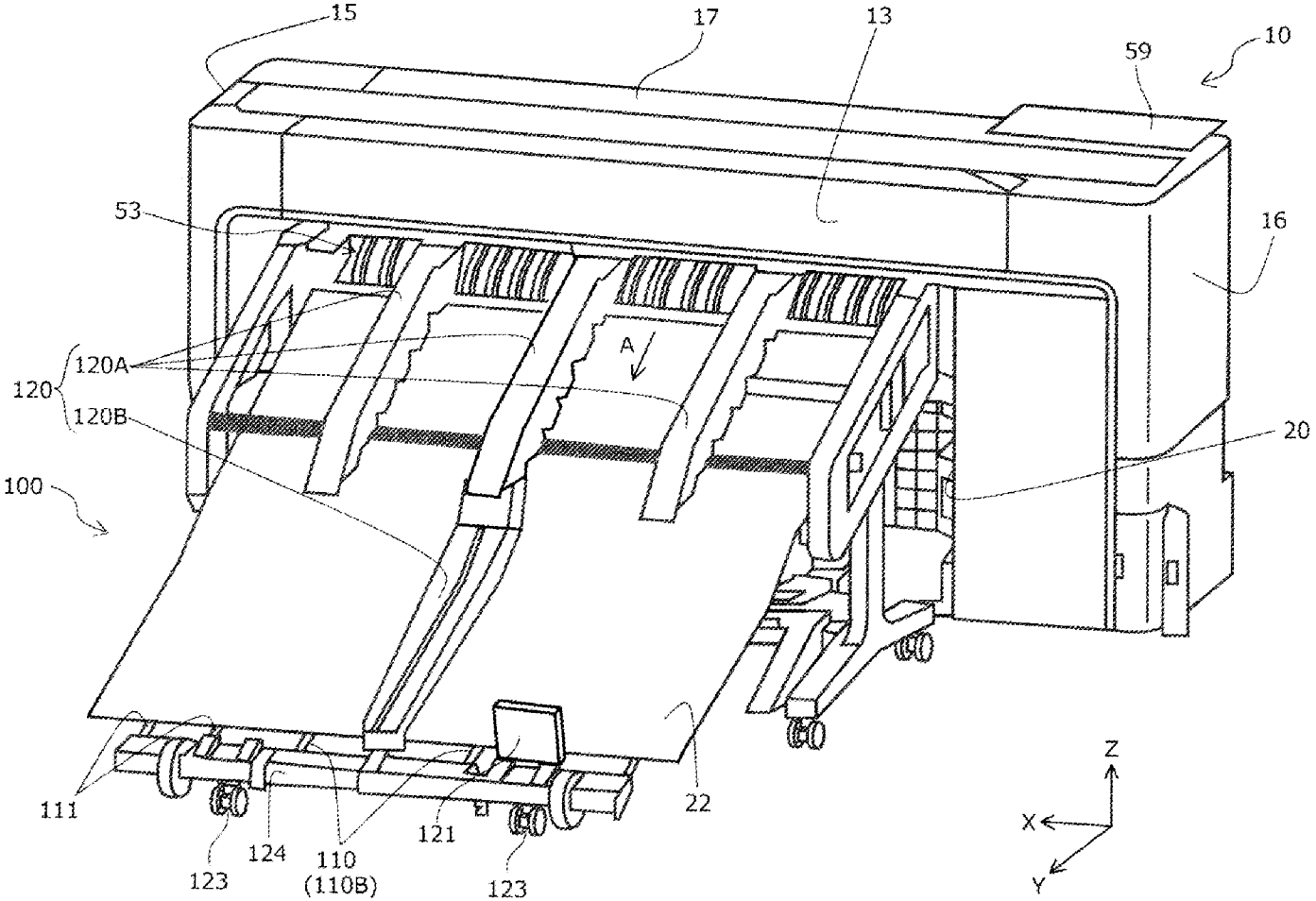
FIG. 2 is a perspective view illustrating a state in which a medium placement device according to the exemplary embodiment of the present disclosure is coupled to the recording device in FIG. 1.
Figure 6:
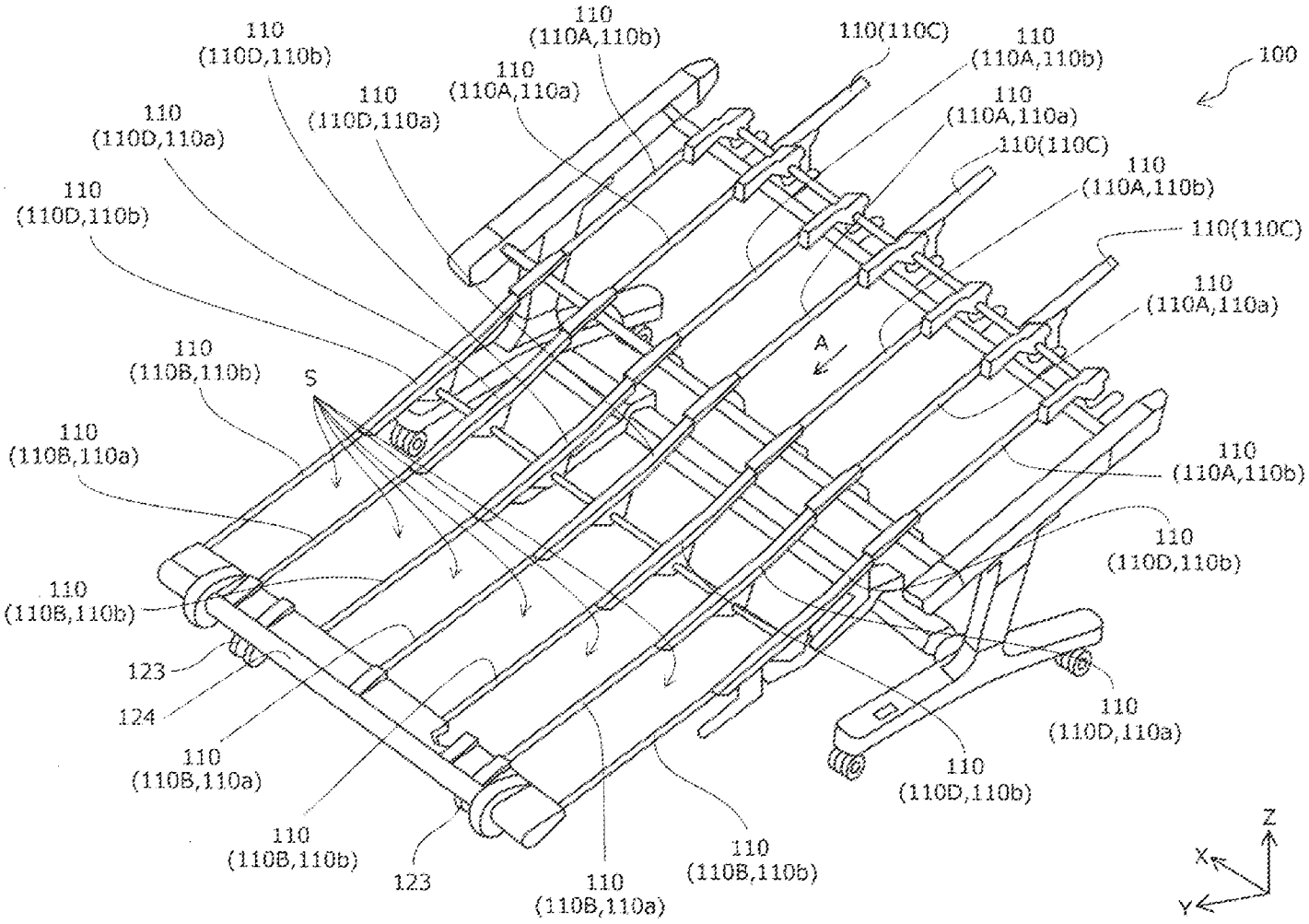
FIG. 6 is a perspective view illustrating a support unit of the medium placement device according to the exemplary embodiment of the present disclosure.
Figure 7:
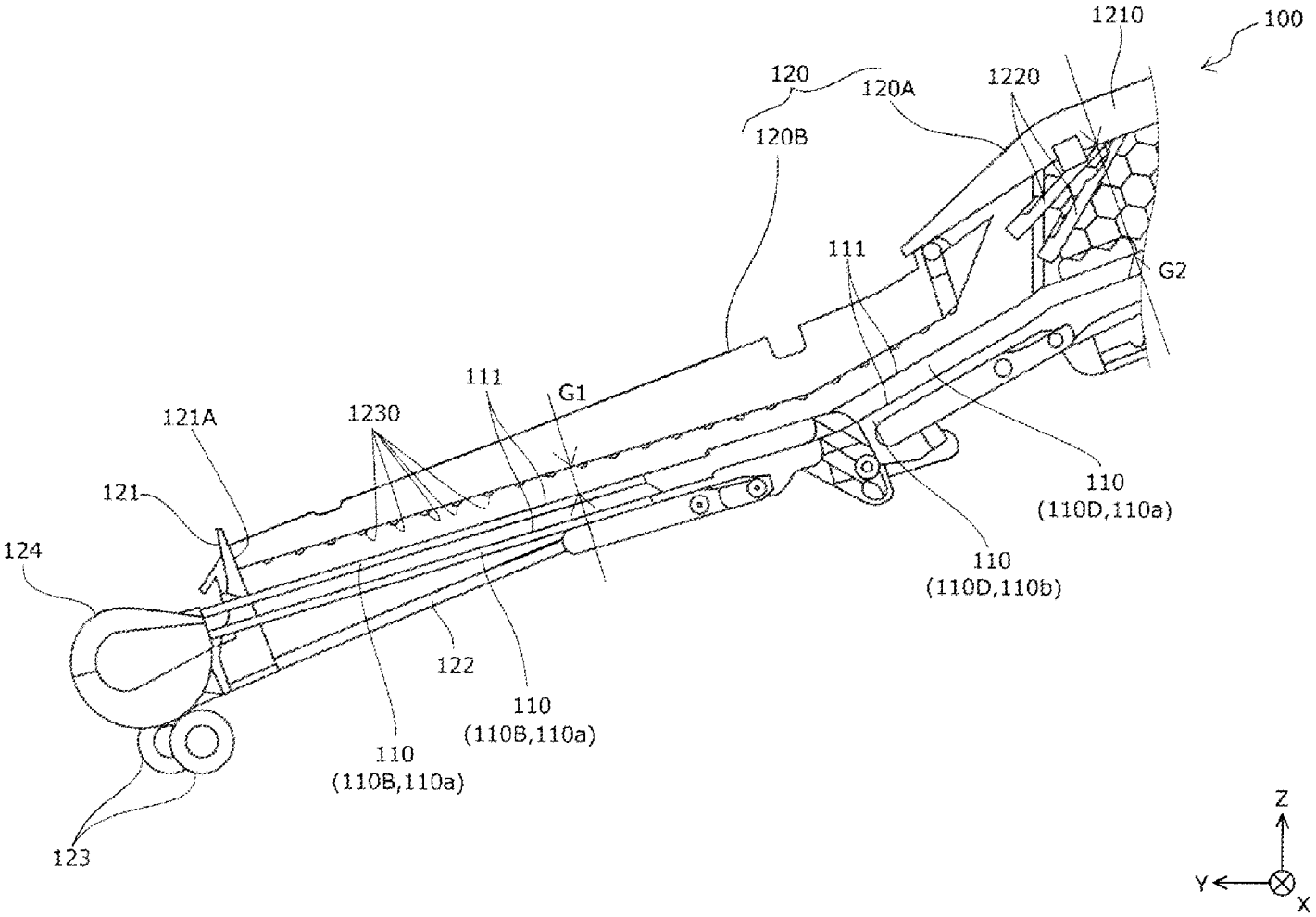
FIG. 7 is a side view illustrating part of the medium placement device according to the exemplary embodiment of the present disclosure.
Figure 8:
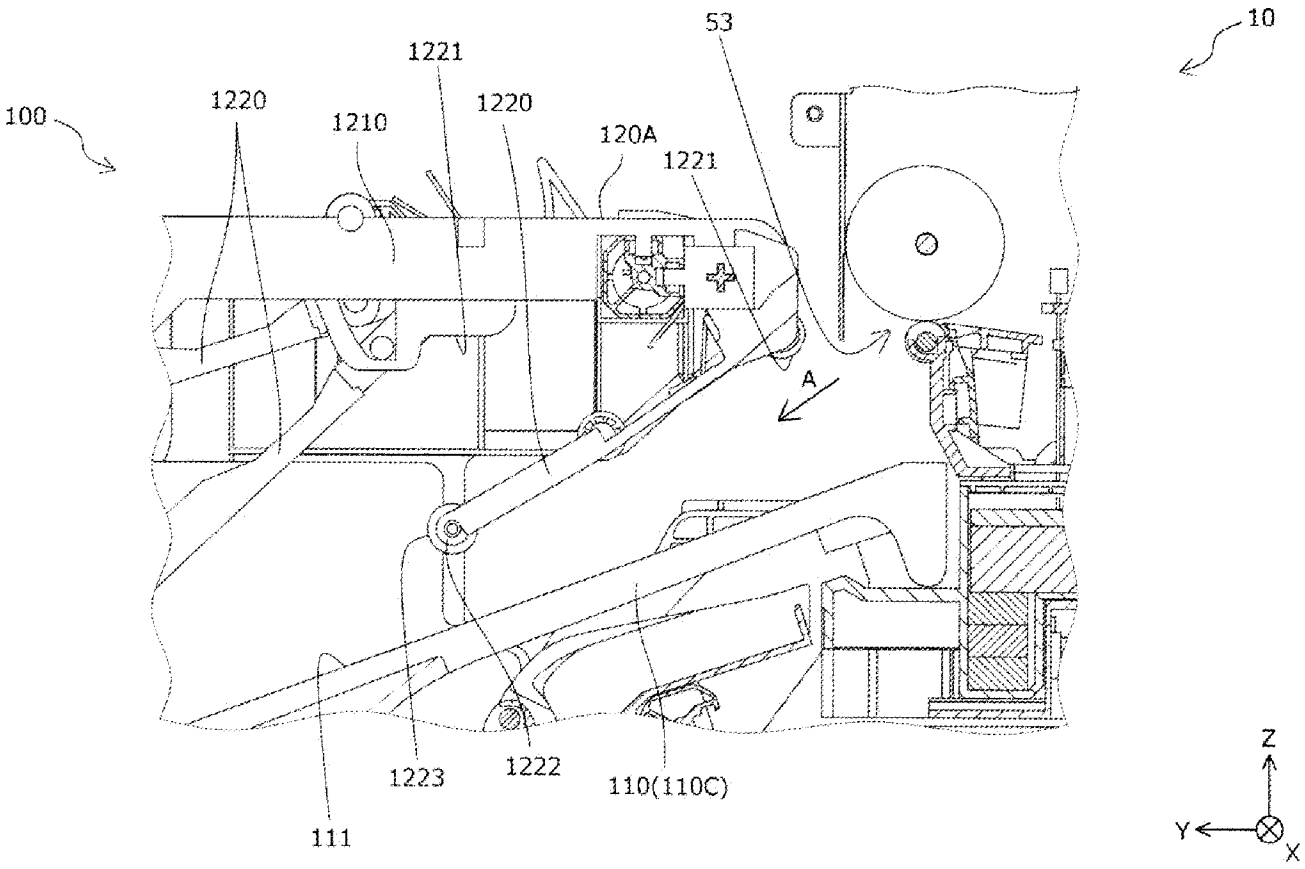
FIG. 8 is a side view illustrating a coupling portion that couples the medium placement device according to the exemplary embodiment of the present disclosure to the recording device.

Next, with reference to FIG. 2 to FIG. 9, the medium placement device 100 according to the exemplary embodiment of the present disclosure is specifically described. As illustrated in FIG. 2 and FIG. 8, the medium placement device 100 according to the present exemplary embodiment is configured to be coupled to the recording device 10 and to stack a plurality of sheets of the medium 22, which is discharged from the discharge unit 53 of the recording device 10 in a discharge direction A, on a support surface 111 of a support unit 110.

Figure 3:
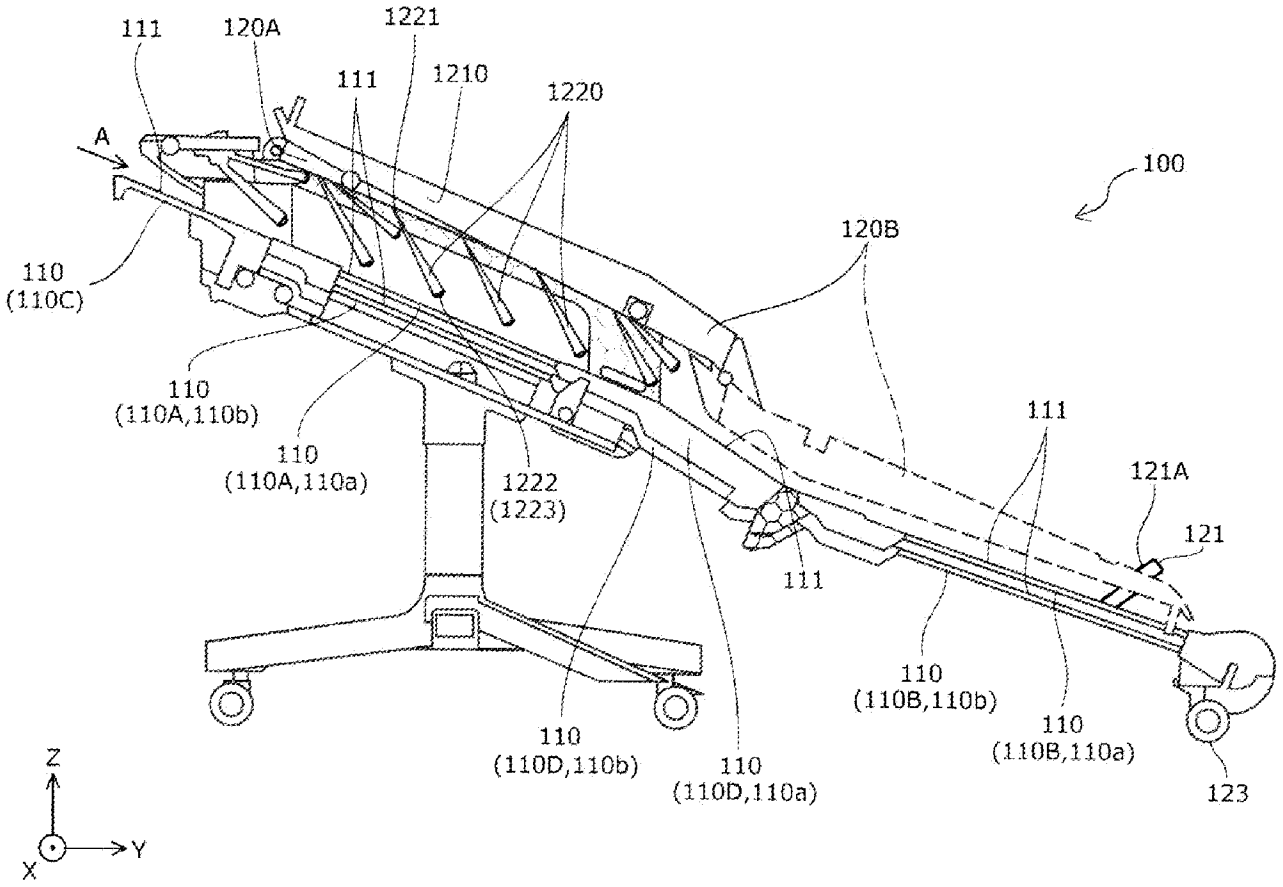
FIG. 3 is a side view of the medium placement device according to the exemplary embodiment of the present disclosure.
Figure 4:
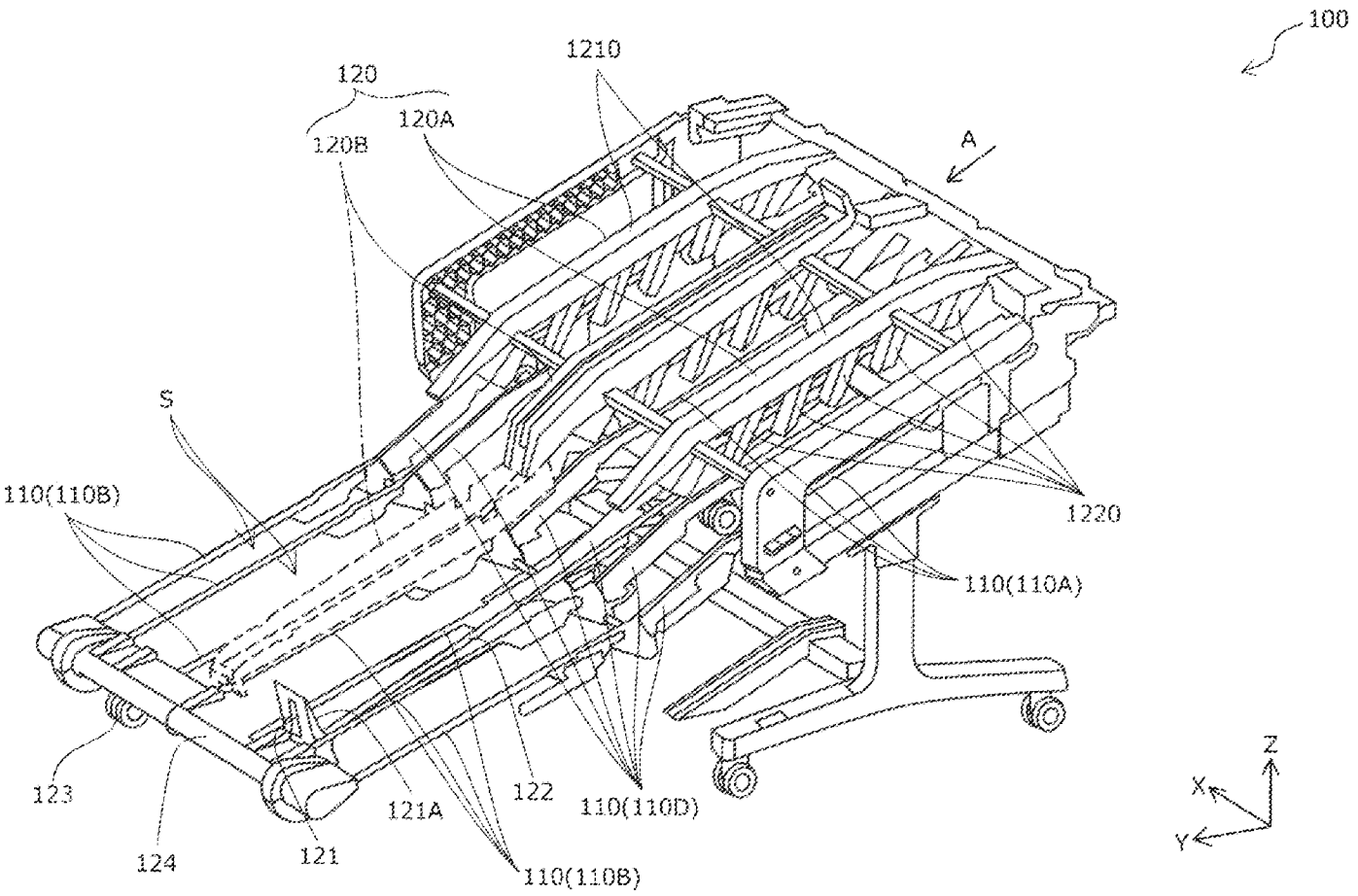
FIG. 4 is a perspective view of the medium placement device according the exemplary embodiment of the present disclosure.
Figure 5:
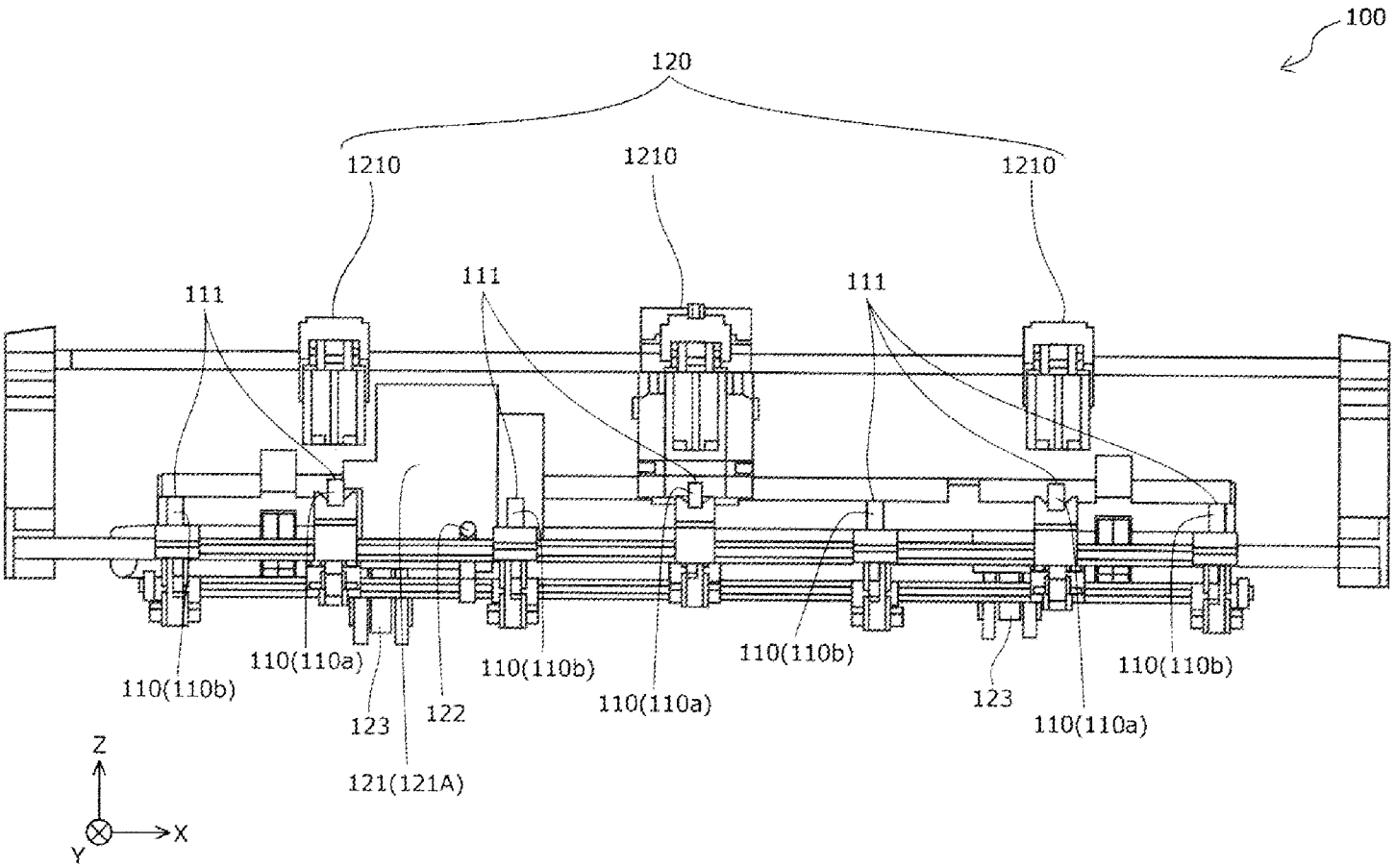
FIG. 5 is a back view of the medium placement device according to the exemplary embodiment of the present disclosure.

As illustrated in FIG. 4 and FIG. 6, the medium placement device 100 according to the present exemplary embodiment includes a plurality of support units 110 provided in a width direction (X direction) intersecting with the discharge direction A of the medium 22. With this, the medium 22 discharged from the discharge unit 53 is supported on the support surface 111 from below in the gravitational direction (Z direction). In the medium placement device 100 according to the present exemplary embodiment, the plurality of support units are arranged so that the center positions of the adjacent support units 110 in the width direction are at an interval of 160 mm. Here, as illustrated in FIG. 3, FIG. 4, and the like, the support units 110 are provided extending in the discharge direction A, and are inclined downward in the gravitational direction from upstream to downstream in the discharge direction A. Further, as the support units 110, a first support unit 110*a* and a second support unit 110*b* are provided in an alternating manner in the X direction, as illustrated in FIG. 5, FIG. 6, and the like. As illustrated in FIG. 3, the second support unit 110*b* is arranged at a lower position in the Z direction with respect to the first support unit 110*a* as viewed in the X direction.

In this manner, in the medium placement device 100 according to the present exemplary embodiment, the support unit 110 is provided extending in the discharge direction A, and is inclined downward in the gravitational direction from upstream to downstream in the discharge direction A. With this, the medium 22 can be moved through use of a gravitational force, and the medium 22 can efficiently be moved without using electric power or the like. Further, as the support units 110, the first support unit 110*a* and the second support unit 110*b* are provided in an alternating manner in the width direction. Thus, the moving medium 22 can have a wavy form (cockling shape) as viewed in the discharge direction A. The leading edge in the discharge direction A can be prevented from hanging down, and can also be prevented from being caught by the support surface 111 or a placed medium that is previously placed on the support surface 111. Therefore, the medium placement device 100 according to the present exemplary embodiment is capable of stacking various types of the medium 22 in a suitable manner without using electric power or the like. Note that, in the medium placement device 100 according to the present exemplary embodiment, as illustrated in FIG. 5, the heights of the first support units 110*a* and the heights of the second support units 110*b* are substantially the same. However, the above-described configuration is not intended to result in limitation. The heights of the first support units 110*a* and the heights of the second support units 110*b* may be different. Further, in the medium placement device 100 according to the present exemplary embodiment, a difference of the height of the first support unit 110*a* and the height of the second support unit 110*b* is 45 mm. However, the height is not limited to 45 mm as long as the medium 22 can have a wavy form.

Further, as illustrated in FIG. 3, FIG. 4, FIG. 6, and the like, in the medium placement device 100 according to the present exemplary embodiment, each of the support units 110 includes an upstream portion 110A that is located upstream in the discharge direction A, a downstream portion 110B that is located downstream of the upstream portion 110A in the discharge direction A, and an intermediate portion 110D that couples the upstream portion 110A and the downstream portion 110B to each other. Further, as illustrated in FIG. 3, the intermediate portion 110D is inclined in a steeper manner than the upstream portion 110A and the downstream portion 110B as viewed in the X direction.

For example, when the medium 22 having a large size of B0 plus is used, a jam of the medium 22 to be discharged is more likely to occur at the intermediate portion 110D. With this, a configuration in which the medium 22 easily moves on the intermediate portion 110D is preferred. Here, in the medium placement device 100 according to the present exemplary embodiment, the support unit 110 includes the upstream portion 110A, the downstream portion 110B, and the intermediate portion 110D, and the intermediate portion 110D is inclined in a steeper manner than the upstream portion and the downstream portion as viewed in the X direction. As described above, the intermediate portion 110D is inclined in a steeper manner, and hence the medium 22 can be moved on the intermediate portion 110D through use of a gravitational force in a particularly effective manner. Therefore, the medium placement device 100 according to the present exemplary embodiment is capable of stably stacking various types of the medium 22 in a particularly suitable manner without using electric power or the like.

Note that, in the present exemplary embodiment, a bridging member 110C is provided further upstream of the upstream portion 110A in the discharge direction A. The bridging member 110C couples the lower side of the discharge unit 53 of the recording device 10 and the upstream portion 110A to each other. Further, in the present exemplary embodiment, the intermediate portion 110D is inclined in a steeper manner than the upstream portion 110A and the downstream portion 110B, and the upstream portion 110A is inclined in a steeper manner than the downstream portion 110B. However, the above-described configuration is not intended to result in limitation. For example, the upstream portion 110A and the downstream portion 110B may be inclined at the same degree. Further, in the present exemplary embodiment, the position of the intermediate portion 110D in the discharge direction A is in the vicinity of the center of the entire length of the support unit 110 in the discharge direction A. In other words, this position corresponds to a vicinity of the center of the medium 22 in the discharge direction A, which has a size of B0 plus being a maximum size stackable on the medium placement device 100 according to the present exemplary embodiment. However, the position and the length of the intermediate portion 110D in the discharge direction A are not particularly limited. The position and the length of the intermediate portion 110D in the discharge direction can be determined as appropriate in accordance with a type and a size of the medium 22 to be used.

Further, as illustrated in FIG. 4 and FIG. 6, the medium placement device 100 according to the present exemplary embodiment is configured so that a space S is provided between the first support unit 110*a* and the second support unit 110*b* in the X direction and the width of the space S in the X direction is larger than the width of the support surface 111 in the X direction. In other words, in the medium placement device 100 according to the present exemplary embodiment, a contact area between the support surface 111 and the medium 22 is small. With this, a frictional force between the support surface 111 and the medium 22 can be reduced, and various types of the medium 22 can be stacked in a particularly suitable manner without using electric power or the like. Further, the support unit 110 can be formed to have light weight, and thus the medium placement device 100 can be reduced in weight.

Further, as illustrated in FIG. 2, FIG. 5, and the like, the medium placement device 100 according to the present exemplary embodiment includes a pressing unit 120 that presses down the medium 22, which is supported on the support unit 110, from above in the Z direction. Further, as illustrated in FIG. 5, the pressing unit 120 is arranged at a position facing the support surface 111 of the first support unit 110*a*. With this configuration of the medium placement device 100 according to the present exemplary embodiment, the medium 22 can be sandwiched in the vertical direction between the pressing unit 120 and the support surface 111 of the first support unit 110*a*. With this, the medium 22 can be prevented from curling as viewed in the X direction, and the part corresponding to the leading edge of the medium 22 can be prevented from being caught by the support surface 111 or a placed medium in a suitable manner.

Further, as illustrated in FIG. 2 to FIG. 5 and the like, the medium placement device 100 according to the present exemplary embodiment includes a regulation unit 121 having a regulation surface 121A that is provided to extend from the side close to the support surface 111 (−Z side) to the side close to the pressing unit 120 (+Z side). With this, the medium 22 supported by the support unit 110 is prevented from moving downstream in the discharge direction A. Further, as illustrated in FIG. 9, as viewed in the X direction, the regulation surface 121A has an end portion 121B on the side close to the pressing unit 120, which is arranged downstream of an end portion 121C on the side close to the support surface 111 in the discharge direction A, and hence is arranged to be inclined more than a vertical line L1 with respect to the support surface 111.

As described above, the medium placement device 100 according to the present exemplary embodiment includes a regulation unit 121 that prevents the medium 22 supported on the support unit 110 from moving downstream in the discharge direction A. Further, as illustrated with a medium 22*a* in FIG. 9, the regulation unit 121 aligns a downstream leading edge of the medium 22 in the discharge direction A. With this, when the media 22 are continuously placed on the support unit 110, the leading edge of the subsequent medium 22 that is moving for placement is prevented from abutting against and being caught by a placed medium that is previously stacked below the subsequent medium. Thus, in an effective manner, improper discharge of the subsequent moving medium 22 can be prevented, and the placed medium can be prevented from being pushed out from the support unit 110.

Figure 9:
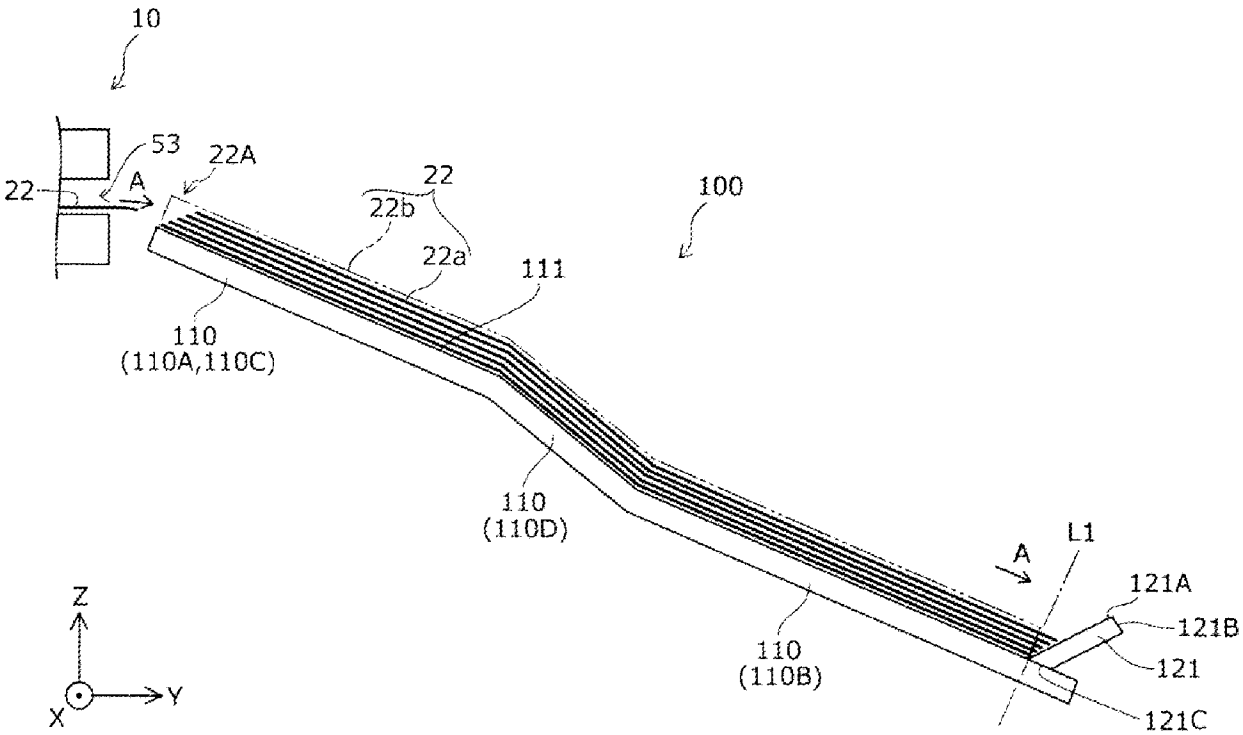
FIG. 9 is a side view schematically illustrating a state in which a medium is stacked on the medium placement device according to first exemplary embodiment of the present disclosure.

Further, as illustrated in FIG. 9, as viewed in the X direction, the regulation surface 121A has the end 121B on the side close to the pressing unit 120, which is arranged downstream of the end 121C on the side close to the support surface 111 in the discharge direction A, and hence is arranged to be inclined more than the vertical line L1 with respect to the support surface 111. In FIG. 9, the placed medium in the configuration the present exemplary embodiment is indicated with the medium 22*a*, and a placed medium arranged when the regulation surface 121A is inclined similarly to the line L1 is indicated with a medium 22*b*. As apparent from comparison between the medium 22*a* and the medium 22*b*, the medium 22 being discharged from the discharge unit 53 is less likely to be caught by a trailing edge 22A of the placed medium in a case of the medium 22*a* than in a case of the medium 22*b*. Thus, in the medium placement device 100 according to the present exemplary embodiment, a height from the discharge unit 53 to the placed medium can be secured. Further, the medium 22 being discharged from the discharge unit 53 can be prevented from being caught by the trailing edge 22A of the placed medium in an effective manner. Therefore, the medium placement device 100 according to the present exemplary embodiment is capable of efficiently stacking a large number of the media 22.

Note that, as illustrated in FIG. 4, FIG. 5, and the like, in the medium placement device 100 according to the present exemplary embodiment, the regulation unit 121 is provided on the −X side in the X direction. This is because the recording device 10 that is used together with the medium placement device 100 according to the present exemplary embodiment includes the carriage 33 at a home position on the −X side, and is used with the medium 22 on the −X side. With this, the above-described configuration is not intended to result in limitation, and the medium placement device 100 may be arranged in a freely selectable manner in accordance with a mode of a processing device to be used in combination.

Further, as illustrated in FIG. 4 and FIG. 7, the medium placement device 100 according to the present exemplary embodiment includes a regulation unit holding shaft 122 provided along the discharge direction A. Further, the regulation unit 121 is movable along the regulation unit holding shaft 122. In this manner, the regulation unit 121 is movable along the discharge direction A. With this, in the medium placement device 100 according to the present exemplary embodiment, the position of the regulation unit 121 can suitably be changed in accordance with a size of the medium 22 to be used, and hence the medium 22 can suitably be stacked.

Further, as illustrated in FIG. 2 to FIG. 4, and the like, the pressing unit 120 of the medium placement device 100 according to the present exemplary embodiment includes an upstream pressing unit 120A and a downstream pressing unit 120B arranged at a position that is downstream of the upstream pressing unit 120A in the discharge direction A and includes the center in the X direction. With this, in the medium placement device 100 according to the present exemplary embodiment, only the upstream pressing unit 120A can be used when a short medium 22 is used, and both the upstream pressing unit 120A and the downstream pressing unit 120B can be use when a long medium 22 is used. Therefore, even when the long medium 22 is used as well as the short medium 22, the medium 22 can effectively be sandwiched between the pressing unit 120 and the support surface 111 in the vertical direction in the medium placement device 100 according to the present exemplary embodiment. When the short medium 22 is used, the downstream pressing unit 120B can rotatably move and be folded. FIG. 3 and FIG. 4 illustrate both states, namely, a use state and a non-use state.

Here, as illustrated in FIG. 3, FIG. 8, and the like, the upstream pressing unit 120A includes a base portion 1210 provided extending in the discharge direction A and a plurality of arm portions 1220 provided at positions of the base portion 1210, which faces the support surface 111. The arm portion 1220 has a base end 1221 and a distal end 1222 opposite to the base end 1221. The base end 1221 is rotatably attached to the base portion 1210 with the X direction as a rotational movement axis, and a rotating member 1223 that is rotatable with the X direction as a rotation axis is provided to the distal end 1222. Meanwhile, as illustrated in FIG. 7, the downstream pressing unit 120B is provided with a plurality of rotors 1230 that are provided extending in the discharge direction A and are rotatable with the X direction as a rotation axis at positions facing the support surface 111. Further, as illustrated in FIG. 7, a gap G1 between the downstream pressing unit 120B and the support surface 111 is configured to be smaller than a gap G2 between the base portion 1210 and the support surface 111.

In general, when the short medium 22 is used, the number of stacked media 22 is greater than a case in which the long medium 22 is used. For example, two rolls of the roll bodies 25 can be set in the recording device 10 in FIG. 1, which can be used together with the medium placement device 100 according to the present exemplary embodiment. Thus, when the roll body 25 is cut to have a short length, the number of media 22 is increased. Similarly, when the roll body 25 is cut to have a long length, the number of media 22 is reduced. In the medium placement device 100 according to the present exemplary embodiment, the gap G1 between the downstream pressing unit 120B and the support surface 111 is smaller than the gap G2 between the base portion 1210 and the support surface 111. With this, the number of stackable media 22 at the time of using the short medium 22 can be increased more than the number of stackable media 22 at the time of using the long medium 22. Further, the upstream pressing unit 120A includes the base portion 1210 and the plurality of arm portions 1220. The base end 1221 of the arm portion 1220 can rotatably move in the width direction as a rotational movement axis with respect to the base portion 1210, and the distal end 1222 of the arm portion 1220 is provided with the rotating member 1223. With this configuration, the medium 22 can firmly be pressed down upstream in the discharge direction A, and the medium 22 can suitably be moved. Further, the rotating member 1223 and the rotor 1230 are provided, and hence the medium 22 can smoothly move.

Further, as illustrated in FIG. 2, FIG. 7, and the like, the medium placement device 100 according to the present exemplary embodiment includes casters 123 on the lower side in the gravitational direction at a downstream end 124 in the discharge direction A. With this, the casters 123 can be installed on the installation surface, and thus the medium placement device 100 can stably be installed. Moreover, the medium placement device 100 can easily move.

The present disclosure is not limited to the exemplary embodiments described above, and can be achieved in various configurations without departing from the gist of the present disclosure. For example, appropriate replacements or combinations may be made to the technical features in the present exemplary embodiments which correspond to the technical features in the aspects described in the SUMMARY section to solve some or all of the problems described above or to achieve some or all of the advantageous effects described above. Additionally, when the technical features are not described herein as essential technical features, such technical features may be deleted appropriately.

What is claimed is:

1. A medium placement device configured to stack a plurality of sheets of a medium discharged from a discharge unit of a processing device, the medium placement device comprising:

a plurality of support units provided in a width direction intersecting with a discharge direction of the medium discharged from the discharge unit, the plurality of support units being configured to support the medium at a support surface from below in a gravitational direction; and a plurality of pressing units configured to press, from above in the gravitational direction, the medium supported by the plurality of support units, wherein the plurality of support units provided extending in the discharge direction, and are inclined downward in a gravitational direction from upstream to downstream in the discharge direction, as the plurality of support units, a first support unit and a second support unit are provided in an alternating manner in the width direction, the second support unit being arranged at a position lower than the first support unit in the gravitational direction when viewed in the width direction, and each of the plurality of the pressing units is arranged at a position facing the support surface of the first support unit.

2. The medium placement device according to claim 1, wherein each of the plurality of support units includes an upstream portion located upstream in the discharge direction, a downstream portion located downstream of the upstream portion in the discharge direction, and an intermediate portion coupling the upstream portion and the downstream portion, and the intermediate portion is inclined steeper than the upstream portion and the downstream portion when viewed in the width direction.

3. The medium placement device according to claim 1, wherein a space is provided between the first support unit and the second support unit in the width direction, and a width of the space in the width direction is larger than a width of the support surface in the width direction.

4. The medium placement device according to claim 1, comprising a regulation unit including a regulation surface provided to extend from a side close to the support surface to a side close to the pressing unit, the regulation unit being configured to prevent the medium supported by the plurality of support units from moving downstream in the discharge direction, wherein at the regulation surface, an end portion on a side close to the pressing unit is located downstream in the discharge direction with respect to an end portion on a side close to the support surface when viewed in the width direction, so that the regulation surface is arranged to be more inclined than a line perpendicular to the support surface.

5. The medium placement device according to claim 4, wherein the regulation unit is movable along the discharge direction.

6. The medium placement device according to claim 1, wherein as the plurality of pressing units, an upstream pressing unit and a downstream pressing unit are provided, the downstream pressing unit being arranged at a position that is including a center in the width direction and is downstream of the upstream pressing unit in the discharge direction.

7. The medium placement device according to claim 6, wherein the upstream pressing unit includes a base portion provided extending in the discharge direction, and a plurality of arm portions provided at positions facing the support surface on the base portion, each of the plurality of arm portions includes a base end attached to the base portion so as to move rotatably in the width direction as a rotational movement axis, and is provided with a rotating member rotatable with the width direction as a rotation axis at a distal end on an opposite side of the arm portion from the base end, the downstream pressing unit is provided with a plurality of rotors at positions facing the support surface, the plurality of rotors being provided extending in the discharge direction and being rotatable with the width direction as a rotation axis, and a gap between the downstream pressing unit and the support surface is smaller than a gap between the base portion and the support surface.

8. The medium placement device according to claim 1, comprising a caster on a lower side in the gravitational direction at a downstream end in the discharge direction.

9. A medium placement device configured to stack a plurality of sheets of a medium discharged from a discharge unit of a processing device, the medium placement device comprising:

a plurality of support units provided in a width direction intersecting with a discharge direction of the medium discharged from the discharge unit, the plurality of support units being configured to support the medium at a support surface from below in a gravitational direction, wherein the plurality of support units provided extending in the discharge direction, and are inclined downward in a gravitational direction from upstream to downstream in the discharge direction, as the plurality of support units, a first support unit and a second support unit are provided in an alternating manner in the width direction, the second support unit being arranged at a position lower than the first support unit in the gravitational direction when viewed in the width direction, each of the plurality of support units includes an upstream portion located upstream in the discharge direction, a downstream portion located downstream of the upstream portion in the discharge direction, and an intermediate portion coupling the upstream portion and the downstream portion, and the intermediate portion is inclined steeper than the upstream portion and the downstream portion when viewed in the width direction.

10. A medium placement device configured to stack a plurality of sheets of a medium discharged from a discharge unit of a processing device, the medium placement device comprising:

a plurality of support units provided in a width direction intersecting with a discharge direction of the medium discharged from the discharge unit, the plurality of support units being configured to support the medium at a support surface from below in a gravitational direction; and a caster on a lower side in the gravitational direction at a downstream end in the discharge direction, wherein the plurality of support units provided extending in the discharge direction, and are inclined downward in a gravitational direction from upstream to downstream in the discharge direction, and as the plurality of support units, a first support unit and a second support unit are provided in an alternating manner in the width direction, the second support unit being arranged at a position lower than the first support unit in the gravitational direction when viewed in the width direction.

* * * * *